US006705310B2

(12) United States Patent
Buzzard et al.

(10) Patent No.: US 6,705,310 B2
(45) Date of Patent: Mar. 16, 2004

(54) WOOD BURNER WITH IMPROVED EMISSIONS

(75) Inventors: Robert H. Buzzard, Warren, IN (US); Ralph E. Morrison, South Royalton, VT (US)

(73) Assignee: CFM Corporation, Ontario (CA)

( * ) Notice: Subject to any disclaimer, the term of this patent is extended or adjusted under 35 U.S.C. 154(b) by 31 days.

(21) Appl. No.: 10/120,702

(22) Filed: Apr. 10, 2002

(65) Prior Publication Data

US 2003/0192527 A1 Oct. 16, 2003

(51) Int. Cl.[7] ..... F24B 1/189; F24C 1/14

(52) U.S. Cl. ..... 126/524; 126/523; 126/531; 126/552; 126/77

(58) Field of Search ..... 126/524, 523, 126/531, 552, 77, 65, 500, 509, 515

(56) References Cited

U.S. PATENT DOCUMENTS 4,672,946 A * 6/1987 Craver ..... 126/77
5,046,481 A * 9/1991 Warwick ..... 126/522
5,263,471 A * 11/1993 Shimek et al. ..... 126/528
5,701,882 A * 12/1997 Champion ..... 126/523
6,029,654 A * 2/2000 Wade ..... 126/512
6,595,199 B1 * 7/2003 Andersen et al. ..... 126/77

* cited by examiner

*Primary Examiner*—Alfred Basichas
(74) *Attorney, Agent, or Firm*—Baniak Pine & Gannon

(57) ABSTRACT

A wood burner includes a wrapper. A firebox is positioned in the wrapper that defines a combustion chamber. An air inlet is placed in communication with an external air supply. The air inlet includes a conduit to conduct the external air to the combustion chamber and a second conduit. A manifold is positioned above the firebox. The manifold is in communication with the second conduit, and includes one or more manifold chambers for permitting the external air received thereby to become heated. A plurality of air tubes connect to the manifold to receive the heated external air from the manifold, each plurality of air tubes including a plurality of apertures to direct the heated external air into the combustion chamber adjacent an upper inner surface of the firebox.

5 Claims, 7 Drawing Sheets

WOOD BURNER WITH IMPROVED EMISSIONS

FIELD OF THE INVENTION

This invention relates to wood burning heating units and fireplaces. More particularly, the present invention relates to a wood burning assembly that is designed to minimize the exhaust of unburned gases and reduce particulate emission.

BACKGROUND OF THE INVENTION

Wood burners are desirable features in the home. However, for many years, in response of an increased population density in certain areas and increased environmental concerns, wood burners, such as wood-burning fireplaces and heaters have been increasingly regulated with respect to particulate and other emissions.

In recent years the quality of the air has received major consideration. Clean air has become more than a phrase. Significant efforts have been expended to minimize pollutants in the air we breathe. Some examples of these efforts include imposing emission standards on automobile exhausts, shutting down the use of incinerators in apartment houses, and designing or modifying large garbage burning incinerators to meet established standards.

Several of the compounds produced during the combustion of wood are of great concern to environmentalists and to environmental organizations, such as the Federal Government's Environmental Protection Agency (EPA), interested in maintaining, or in some cases establishing, clean air. The problem of air pollution caused by the compounds produced when wood burns has been recognized by many, and a growing number of state and local environmental agencies are considering the regulation of wood burning devices.

As a result of this concern, for example, emission standards for a majority of combustion processes have been established by the EPA. On Feb. 18, 1987, the Environmental Protection Agency (EPA) published in the Federal Register, Volume 52, No. 32, 40 CFR Part 60 entitled "Standards of Performance for New Stationary Sources, Standards of Performance for New Sources, Residential Wood Heaters." These regulations were proposed to control the burgeoning wood stove and fireplace industry, which many believed was substantially adding to the air pollution problem in the United States. These pollutants are varied and many. The primary pollutants include particles of organic compounds, carbon monoxide, volatile organic compounds, and nitrous oxides.

A widespread lack of effective emission reduction devices and methods for many fireplaces and other wood burners has prompted agencies and governments in some areas of the country where emissions from wood burning units are increasingly problematic, to ban their use in times of air pollution. Overall, the number of days during which wood burning is banned is increasing, as are the number of communities that ban their use.

Several emission reduction devices have been suggested in the art. One such fireplace pollutant removal device of the prior art utilizes a filter, a fan, and a smoke detector. In operation, the filter is placed in the flue, the fan is positioned above the filter to draw the exhaust gases up through the filter, and the smoke detector is mounted in front of the fireplace. The smoke detector acts as a monitor of gases reflected from a clogged filter and provides an alarm when the filter needs cleaning. A method of removing the clogged filter provides a roll of thin filter-paper which is scrolled through the flue as segments of the filter-paper saturate with pollutants. This method, however, has perceived drawbacks. For instance, if the paper clogs, smoke may be emitted from the fireplace into the area adjacent to the wood burning chamber.

Another fireplace pollutant filter of the prior art utilizes a ceramic fiber duct positioned, along the flow path of the combustion products, between the combustion chamber and the flue. A first duct portion promotes secondary combustion of unburned products of combustion and a second duct portion directs products of combustion from the front of the combustion chamber to the flue. Though this device may remove some pollutants by the secondary combustion, many may enter the atmosphere due to an incomplete removal by the secondary combustion.

Although there are many catalytic devices designed to reduce pollutants in fluid streams, the backpressures created by these devices can be a design issue. The increased backpressure hinders the fireplace's draw, causing a variety of potential unacceptable consequences, including smoke backing up into the house under certain conditions. Several companies have produced catalytic secondary combustion chambers to reduce the amount of pollution, which while effective, nonetheless substantially increased the cost of the stove.

It is possible to produce a wood burner operating at a very high temperature that creates a condition to substantially reduce the amount of particulate material and air pollutants being emitted from wood burning. However, wood burners having a large firebox volume are more difficult to design in a cost-effective way to reduce particulates and emissions to meet EPA requirements. The problem lies, at least in part, in the difficulty of maintaining high combustion temperatures in all areas within the firebox, and especially when the unit is operated at a slow burn rate.

There is a demand therefore for a wood burner that meets requirements of the EPA emissions regulations. The present invention satisfies the demand.

SUMMARY OF THE INVENTION

The present invention has a principal objective of providing a wood burner having a large combustion chamber volume with a configuration and mechanism for clean burning.

Broadly stated, this is accomplished by providing a novel shape of firebox, which reduces or substantially eliminates cold spots in the combustion chamber, and concentrates heat in the center of the chamber. The thermal mass of the firebox is situated to both initiate pyrolisis (baking the combustion gases from the fuel for use in secondary combustion) and maintain elevated temperatures with the combustion chamber to continue efficient combustion of gases. In addition, a novel manifold/upper refractory panel and air supply arrangement is provided, which when used in combination, uses both exhaust and combustion heat in order to preheat secondary air in the manifold and the upper refractory panel. The manifold includes manifold tubes positioned adjacent the upper refractory panel, which panel includes a novel waveform adapted to direct radiant stored heat into the tubes. Further, a metered primary air inlet and primary air nozzle uses a predetermined orifice diameter to precisely meter incoming air at a variety of settings. In particular, the primary nozzle meters a predetermined flow of air into the combustion chamber when the primary air inlet is set at a slow burn setting. In this manner, the wood burner is clean burning, i.e., emits an acceptable minimal amount of regulated pollutants at a variety of burn rates.

One aspect of the invention provides a wood heater that includes a wrapper. A firebox is positioned in the wrapper defining a combustion chamber. A primary air inlet receives external air. The primary air inlet includes a first conduit to conduct the external air to the combustion chamber and a secondary air inlet for receiving external air including a secondary conduit. A manifold is positioned above the firebox in communication with the secondary conduit. The manifold includes one or more manifold chambers for permitting the external air received thereby to become heated. A plurality of air tubes connected to the manifold receives the heated external air from the manifold. Each of the plurality of air tubes including a plurality of apertures to direct the heated external air into the combustion chamber adjacent an upper inner surface of the firebox.

In other aspects of the invention the firebox may include a lining defining a combustion chamber. The first conduit may include a primary air nozzle having an orifice in communication with the combustion chamber, the orifice having a predetermined diameter to supply a predetermined airflow to the combustion chamber when the wood heater is operated in a slow burn mode. A major portion of the combustion chamber may comprise a rectangular volume. The lining may be comprised of a refractory material. The lining may include a lower refractory panel, a pair of side refractory panels, a rear refractory panel and an upper refractory panel. Each of the pair of side refractory panels may include a convex section extending into the combustion chamber. Each of the pair of side refractory panels may include a concave portion adjacent a rear corner of the combustion chamber wherein each of the pair of side refractory panels abuts a similarly convex portion of the rear refractory panel. The manifold may be positioned above the upper refractory panel and includes one or more inlet for receiving outside air, one or more manifold chamber defined within the manifold in which the temperature of the received air is elevated, and one or more manifold tube positioned in the combustion chamber adjacent an underside surface of the upper refractory panel, the one or more manifold tube being in communication with the one or more manifold chamber and having manifold apertures to conduct the heated air into the combustion chamber. The underside of the upper refractory panel may include a plurality of ramps, each of the one or more manifold tube being positioned between an adjacent pair of the ramps.

Another aspect of the present invention has the firebox positioned in the wrapper, with the firebox comprised of a lining including a lower refractory panel, a pair of side refractory panels, a rear refractory panel and an upper refractory panel. The upper refractory panel includes an underside surface positioned toward the combustion chamber, the underside including a plurality of transverse ramps. A manifold is positioned above the upper refractory panel. The manifold includes one or more inlets for receiving outside air, one or more manifold chambers defined within the manifold in which the temperature of the received air is elevated, and one or more manifold tubes positioned in the combustion chamber adjacent the underside surface, the one or more manifold tubes being in communication with the one or more manifold chambers each having manifold tube apertures to conduct the heated air into the combustion chamber.

Other aspects of the present invention provide a wood heater wherein the manifold further includes a manifold cover. The one or more inlets are connected to the manifold cover and are in communication with outside air to convey the outside air through the manifold cover. A diverter plate may be connected to the manifold cover and spaced therefrom to define therewith a first manifold chamber. The diverter plate may include one or more manifold apertures. A manifold cap may be connected to the diverter plate and spaced therefrom to define therewith a second manifold chamber to receive air from the first manifold chamber through the manifold apertures. The manifold cap may have corrugations that define one or more transverse manifold channels therebetween, each of the one or more manifold channels being aligned with each of the one or more manifold apertures. The one or more manifold tubes are in communication with one of the one or more manifold channels.

Another aspect of the invention provides a lining for a wood burner firebox including a bottom refractory panel including a back edge. A back refractory panel includes a lower edge, the lower edge abutting the bottom refractory panel at the back edge. The back refractory panel includes left and right corners. The left and right corners include concave sections. A pair of side refractory panels abuts the back refractory panel at the left and right corners. The pair of side refractory panels include a convex section to define with the back refractory panel a generally rectangular combustion chamber including arcuate convex left and right rear corners.

Other aspects of the present invention further provide an upper refractory panel including an underside surface. The upper refractory panel may include one or more transverse ramp portions. Each of the one or more ramp portions may include an angled side and a low-angled side. Each of the one or more ramp portions may include one or more slots oriented perpendicular to a length of the ramp portions.

These and other advantages, as well as the invention itself, will become further apparent in the details of construction and operation as more fully described below. Moreover, it should be appreciated that several aspects of the invention can be used in other applications where non-wood combustibles are used.

DETAILED DESCRIPTION OF PRESENTLY PREFERRED EMBODIMENTS

Figures 1, 2, 3, 4:
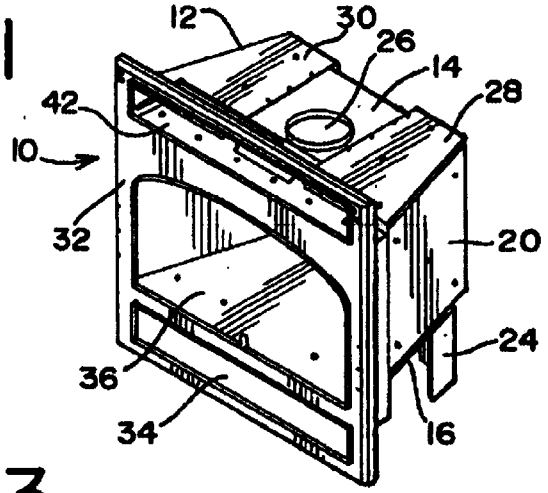
FIG. 1 is a perspective view of one embodiment of a casing assembly of a wood burner made in accordance with the present invention.
FIG. 2 is a front view of the casing assembly of FIG. 1.
FIG. 3 is a side view of FIG. 1.
FIG. 4 is a top view of FIG. 1.

Wood burners generally comprise a framework, which may be referred to as a casing assembly. The wood burner 10 of the present invention includes such a casing assembly 12, shown in FIGS. 1–6.

As best seen in FIGS. 1–4, the wood burner 10 of the present invention includes a casing assembly 12, which is a housing comprised of a number of panels or the like, which will be described more fully below. The panels may be made of a suitable material, such as sheet metal as is known in the art, to create the housing or fireplace casing assembly 12. Cutting, bending and joining a sufficient number of the sheet metal panels or the like can form the structure of the casing assembly 12. The edges of the individual panels are typically bent to provide a small overlap at the juncture of adjoining panels. The metal panels may then be joined together by any suitable fastening method, such as, for example, fasteners, sheet metal screws, or by crimping or welding.

The casing assembly 12 has a top panel 14, bottom panel 16, back panel 18 and side heat shield panels 20, 22. The right side heat shield panel 20 and left side heat shield panel 22 can be joined to angle inwardly toward the back panel 18 to define a generally trapezoidal shape as viewed from above. A support structure 24 is connected to the bottom panel 16 and/or the back panel 18. The support structure 24 may take the form of a leg, or pair of legs to support the underneath and/or rear of the casing assembly.

The top panel 14 includes a circular, or suitable shaped exhaust opening 26 for connecting to a flue (not shown) for venting the exhaust gases generated during use of the wood burner 10. The top panel further includes a pair of upper heat shield assemblies 28, 30, here arranged on either side of the exhaust opening 26.

The casing assembly 12 includes a front plate 32 including a primary air intake 34 defined at a lower portion thereof for entry of primary air into the wood burner 10. The front plate 32 includes a front opening 36 for accessing the interior 38 of the burner 10 for filling the interior 38 of the wood burner 10 with fuel, such as wood, and cleaning, and so on. The front plate 32 may include an upper front air vent 42, to permit air from inside the wood burner 10 to enter the secondary air inlets when in operation. The front plate 32 may further include suitable hardware (not shown) to mount one or more door or panel (not shown) to permit access through the front opening 36 or safe viewing of a fire within, such as of high temperature glass or other suitable material.

Figure 5:
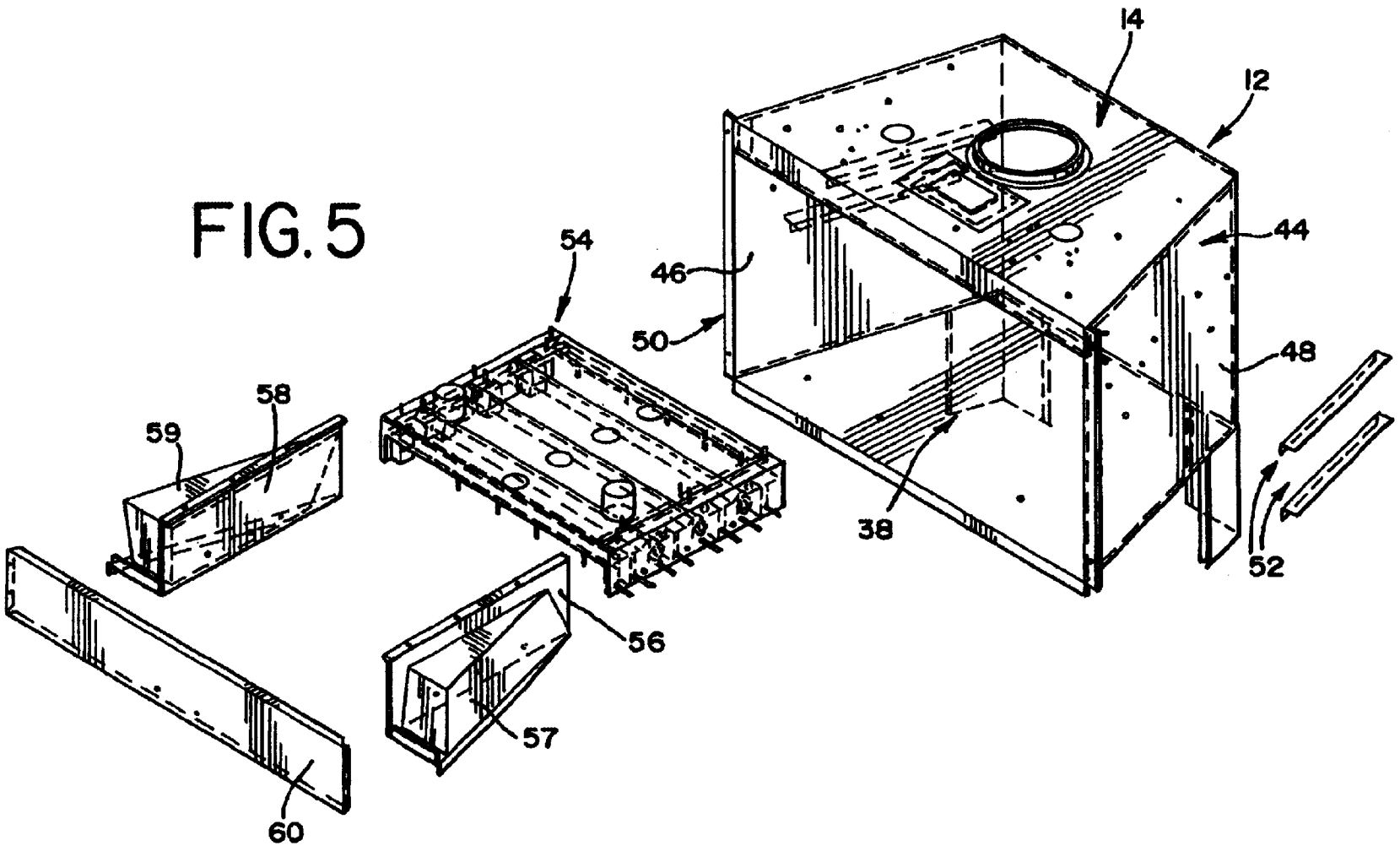
FIG. 5 is an exploded view of one embodiment of a casing assembly and manifold of the present invention.
Figure 6:
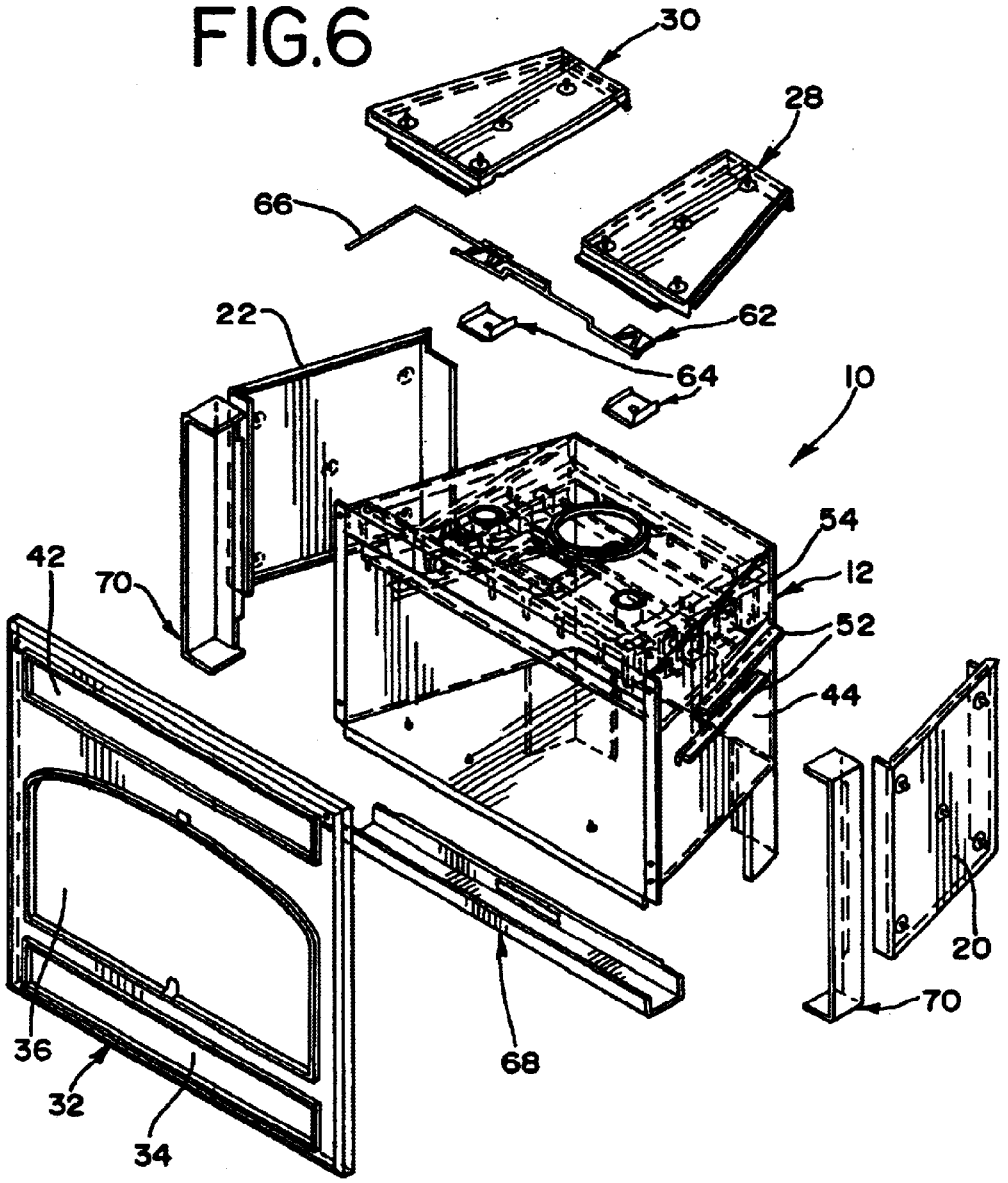
FIG. 6 is an exploded view of a casing assembly, including the manifold, of the present invention.

More details of one embodiment of the wood burner 10 and casing assembly 12 of the present invention are shown in FIGS. 5 and 6. The casing assembly 12 is shown without the right and left heat shield panels 20, 22. Right interior side panel 44 and left interior side panel 46 are positioned inwardly from the right and left heat shield panels 20, 22. The outside surfaces 48, 50 of the right and left interior side panels 44, 46 define right and left side passages (not shown) with the right and left heat shield panels 20, 22 as will shown more clearly below. A plurality of air diverters 52 are affixed to the outside surfaces 48, 50. The air diverters 52 form generally horizontal flanges extending between the outside surfaces 48, 50 of the right and left interior side panels 44, 46 and right and left heat shield panels 20, 22.

A manifold assembly 54 for heating outside air and conveying the heated outside air to the interior 38 of the assembly 12 is provided and positioned generally within the interior of the casing assembly 12 adjacent to but spaced from the top panel 14. The elements and function of the manifold assembly 54 will be described more fully below. Right and left manifold supports 56, 58 bracket the manifold 54 and affix the manifold within the casing assembly 12. The right and left manifold supports 56, 58 also include wedge-shaped refractory brick members 57, 59. A primary air baffle 60 is provided the front plate 32 of the casing assembly 12 operative within the upper front air vent 42.

FIG. 6 shows a secondary door assembly 62 including a pair of secondary doors 64, which can be manipulated to regulate the amount of outside air that enters the manifold 54. Lever 66 is provided to control the doors 64. Bottom primary air channel 68 conducts air from primary air intake 34 to primary air channels 70. Primary air channels 70 conduct the air to the interior 38 of the wood burner 10.

Figure 7:
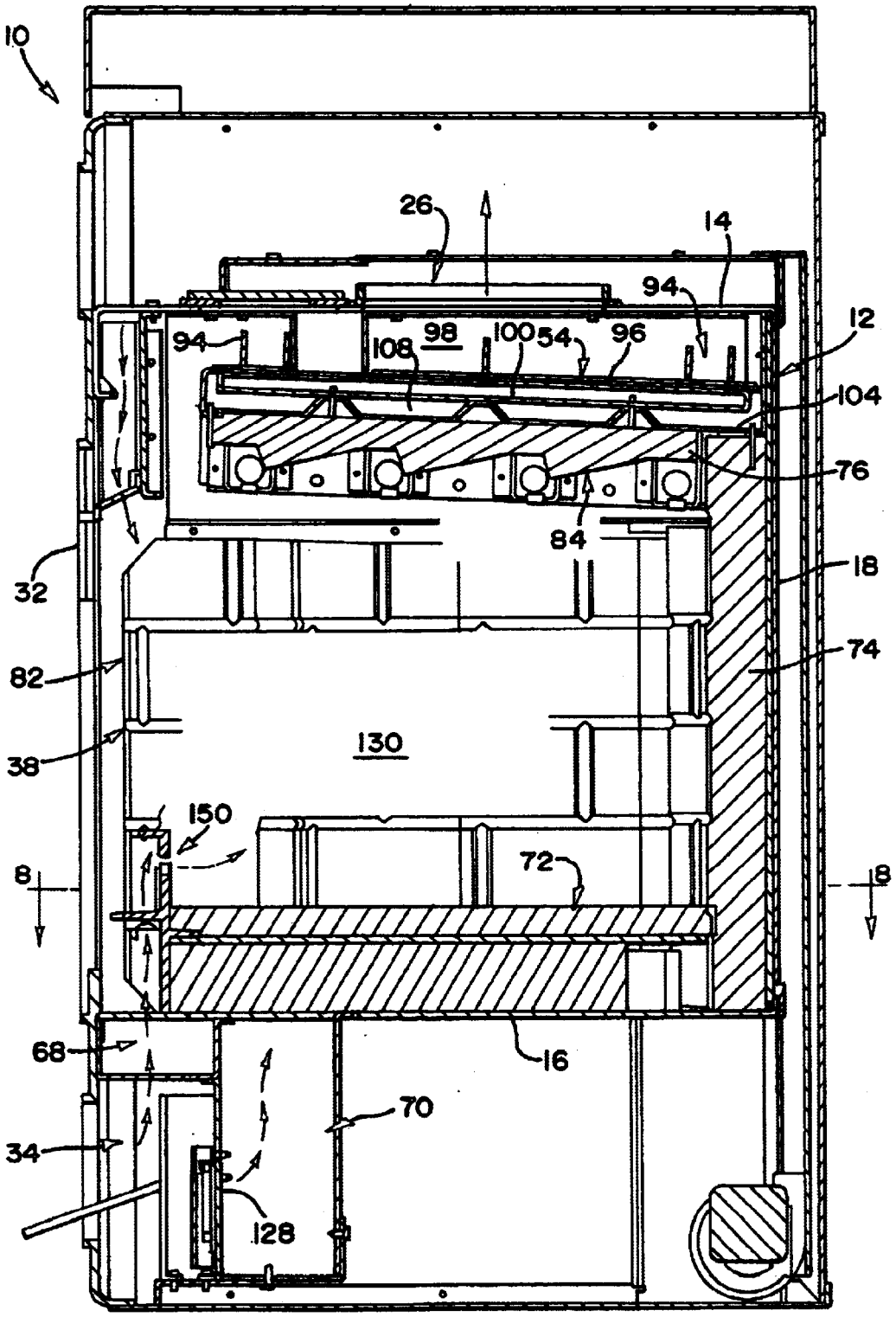
FIG. 7 is side sectional view of an embodiment of a wood burner of the present invention.

FIG. 7 shows a sectional side view of one embodiment of the wood burner 10 of the present invention, and especially with respect to elements residing within the casing assembly 12 and adjacent the interior 38 of the wood burner. Outside air enters primary air intake 34. The air from the intake 34 passes through the primary air tube 92 and enters a volume defined by firebox 82, here referred to as the combustion chamber 130. Air is conducted through the primary air door 128 directed through both the primary air tube 92 and primary air channel 70. It will be understood that the door 128 may be manipulated to regulate the inflow of outside air to produce a variety of flows, including a slow burn condition where only a minimum of airflow is permitted. The air conducted through tube 92 enters the combustion chamber 130. The tube 92 includes an orifice 150 designed to maintain the burn of fuel inside the combustion chamber 130 at a sufficient rate to produce sufficient heat to sufficiently burn off pollutants. The air conducted through the channel 70 is directed into the combustion chamber 130 through the top of the wood burner into the combustion chamber 130 through a metered primary air inlet 92 using an orifice 150 opening to precisely meter incoming air. The inlet orifice 150 preferably has a diameter of 0.156 inches for a combustion chamber of about three and one half cubic feet. The diameter of the inlet orifice 150 may be varied according to the volume of the combustion chamber, for example.

Figure 11:
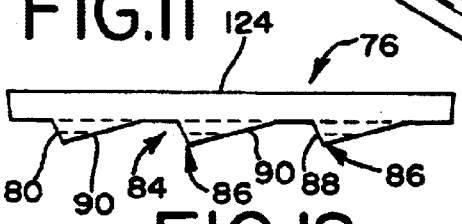
FIG. 11 is a side view of the panel of FIG. 10.
Figure 12:
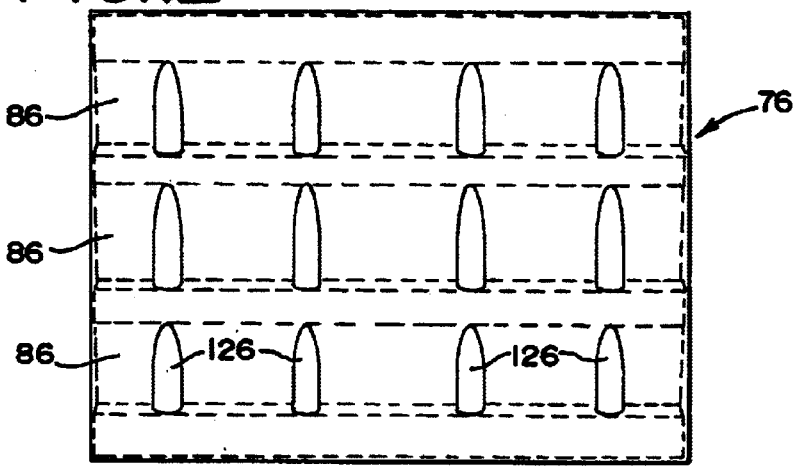
FIG. 12 is a bottom view of the panel of FIG. 10.
Figure 13:
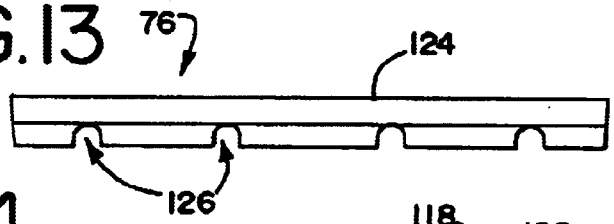
FIG. 13 is a front elevational view of the panel of FIG. 10.

The interior 38 of the wood burner 10 includes a firebox 82, which is lined with a refractory material, which may be in brick form, or preferably in panels designed to appear like brick. A bottom refractory panel 72 is positioned within the interior 38 adjacent the bottom panel 16. The bottom refractory panel 72 is rectangular in cross-section viewed in the section shown in FIG. 7 and of trapezoidal shape. The rear of the bottom refractory panel 72 abuts a lower portion of a back refractory panel 74, which is positioned adjacent to the back panel 18. A top refractory panel 76 is positioned within the interior 38 spaced from the top panel 14. The underside surface 84 of the top refractory panel 76 faces the combustion chamber 130 of the wood burner 10 and is saw tooth in cross-section (See FIG. 11) including a plurality of ramps 86 formed in the underside surface 84. Each ramp 86 includes a short, steeply angled side 88 and an adjoining low-angled side 90. Each angled side 88 is generally oriented to face the opening 36 or front plate 32. Each low-angled side 90 is generally oriented to face toward the bottom panel 16 and slightly rearward toward back panel 18.

Right and left side refractory panels 78 and 80 (see FIG. 8) together with the bottom, back and top refractory panels 72, 74 and 76 comprise the firebox 82. As perhaps best seen in FIG. 8, the right and left side refractory panels 78 and 80 have a novel shape in cross-section as viewed from above. From front to back, each side panel includes an essentially rectangular section A, which comprises about a quarter of the length of the panel 78, 80 measured from the front (i.e., adjacent the front opening). The inside surface of the next quarter of the panel provides a convex arcuate section B having a radius of about six inches. A concave section between A and B has a radius of about 2 inches. The rear approximately half of the panel includes a section C, which tapers in a liner fashion to a point near the rear of the firebox to form a mitered joint 120 with the back refractory panel 74. A short section D, forms a concave arcuate shape having a radius of about 1.4 inches to match with a similarly concave arcuate portion E at the outer edges of the back refractory panel 74. As opposed to angular joints between panel sections in a prior art firebox, it is believed that the arcuate concave section D-E of the present inventive firebox functions to maintain an enhanced airflow and temperature, especially in the rear of the combustion chamber 130 and thus contributes to an enhanced operating condition to reduce emissions thereby. Similarly, sections B and C of right and left panels 78, 80 define a rectangular, or generally square shaped firebox, instead of a conventional trapezoidal shape. In view of the operating conditions needed for a large wood burner, for example having a firebox volume on the order of three cubic feet or more, it is believed that configuring the firebox combustion chamber in such a manner with the refractory panels yields an enhanced operating airflow and/or temperature and thus, contributes to a reduced output of emissions. Further, the increased thermal mass of the lining or firebox including the side panels 78, 80, which are much thicker than a typical refractory lining, contributes to the retention of a high operating temperature inside the combustion chamber.

Figure 8:
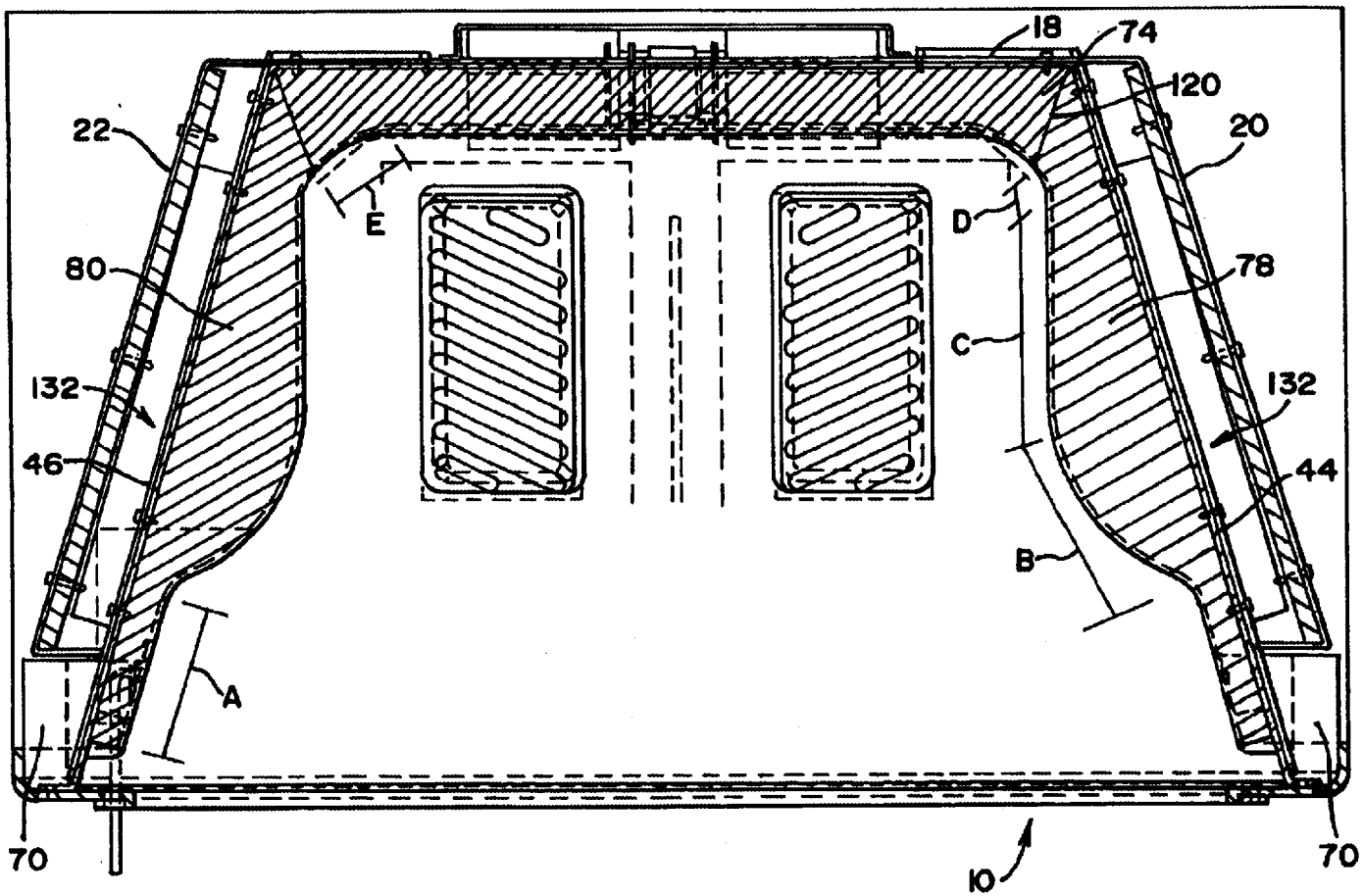
FIG. 8 is a sectional view through lines 8—8 of FIG. 7.
Figure 9:
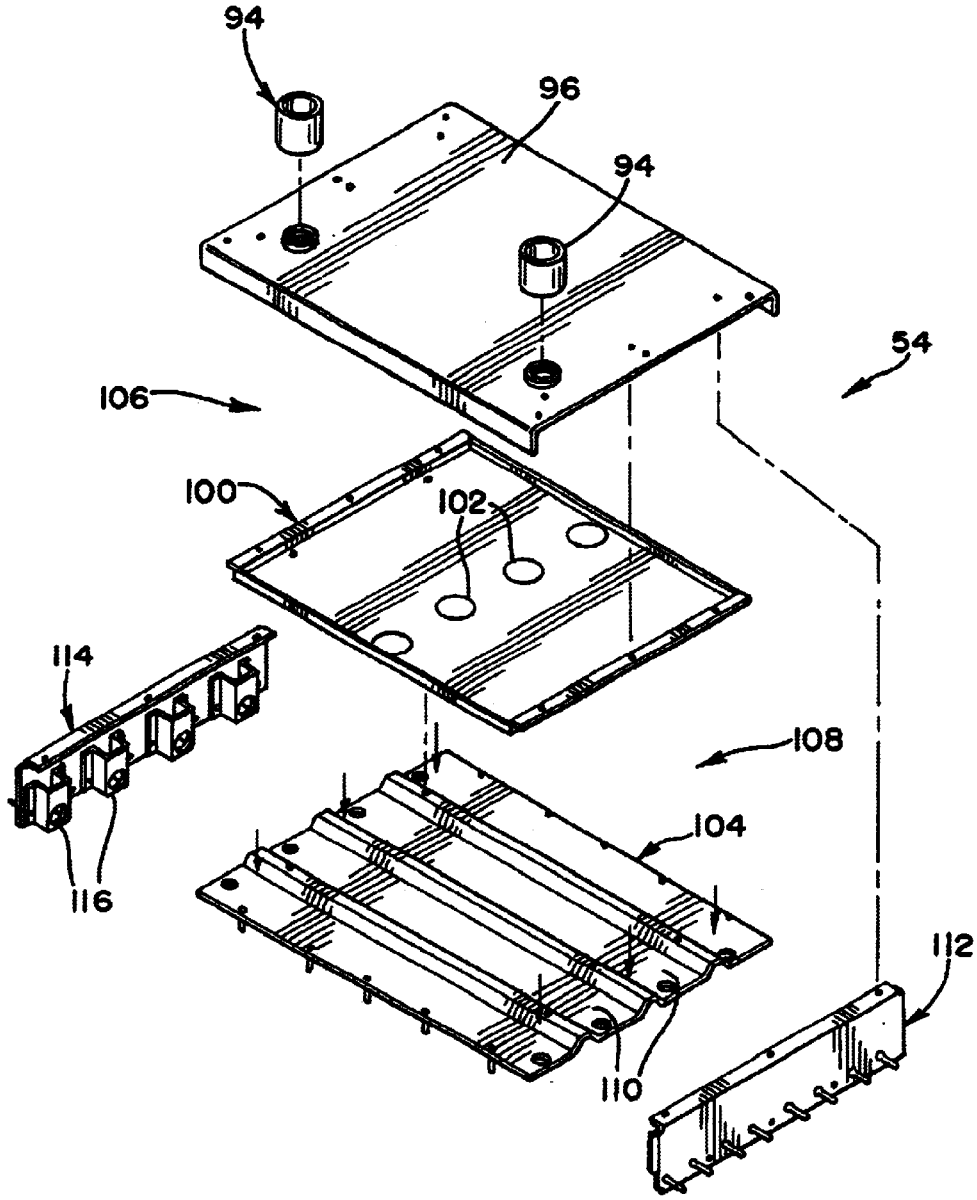
FIG. 9 is an exploded view of a manifold of the present invention.
Figure 10:
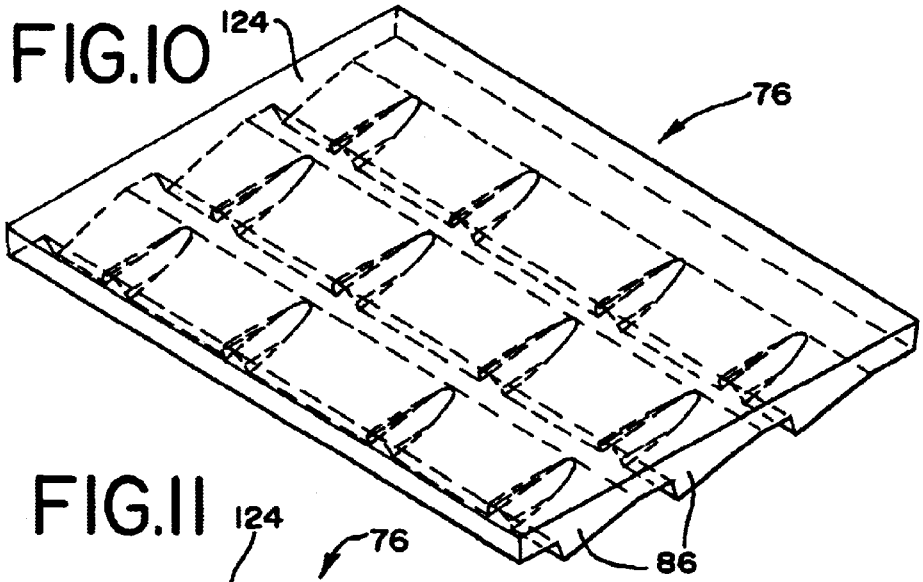
FIG. 10 is a perspective view of an upper refractory panel.

Referring to FIGS. 7–9, the manifold assembly 54 includes a pair of cylindrical inlets 94 connected to and placed in communication with a secondary air chamber 98 formed below top panel 14. The secondary air chamber 98 receives outside air from a secondary air conduit 132 formed in the space between the right and left side heat shield panels 20, 22 and the right and left interior side panels 44, 46, and enters the inlets 94 through secondary doors 64 (See FIG. 6) and enters manifold assembly 54 by way of the sheet metal manifold cover 96. A diverter plate 100 is connected to the manifold cover 96 at edges thereof and is spaced therefrom. The diverter plate 100 includes a plurality of manifold apertures 102. The air from the inlets 94 is conveyed to a first manifold chamber 106 between the manifold cover 96 and the diverter plate 100. The air is directed through the apertures 102 into a second manifold chamber 108 defined between the diverter plate 100 and a spaced manifold cap 104. The manifold cap is corrugated to define a series of transverse manifold channels 110, each aligned with at least one aperture 102 in the diverter plate 100. It will be understood that since the manifold assembly 54 is positioned above the top refractory panel 76, and directly under the flue opening 26 and exposed to exhaust gases thereby, the air becomes heated as it travels through the manifold 54 via space 106 and 108.

Figure 14:
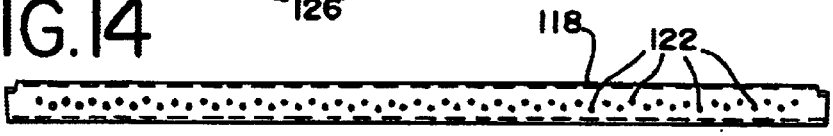
FIG. 14 is a drawing of one embodiment of an air tube of the present invention.

Heated air then spreads along channels 110 and enters right and left manifold bracket assemblies 112, 114. The right and left manifold bracket assemblies 112, 114 include a plurality of tube supports 116, aligned in communication with channels 110. The tube supports 116 extend into the interior of the firebox 82 along the right and left refractory panels 78, 80 and underneath the lower surface 84 of the top refractory panel 76. Opposing pairs of tube supports 116 each carry a cylindrical tube 118 (See FIG. 14) for conveying heated secondary air into the interior of the firebox 82. Each tube includes a plurality of tube apertures 122 arranged along the length of the tube to permit heated secondary air to enter the interior of the firebox 82 adjacent the underside surface 82 of the top refractory panel 76. The heated secondary air permits any residual unburned materials, gases, particulates and so on, to be further reduced by burning.

As best seen in FIGS. 10–13 the top refractory panel 76 is shown in detail. The top panel 76 includes a top panel upper surface 124 for mounting adjacent the manifold cap 104. The underside 84 includes three or other suitable number of sawtooth-shaped ramps 86, each including an angled side 88 and a low-angled side 90. It can be seen that each ramp 86 extends across the width of the top panel 76. Each ramp 86 further may include four slots 126, which function to urge airflow from the rear of the firebox interior to the front. It will be understood that the specific number of ramps 86 and slots 126 may be varied. The inventive refractory lining and manifold each contribute to the reduction of emissions of the wood burner of the present invention.

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless come within the scope of the invention and range of the claims.

What is claimed is:

1. A lining for a wood burner firebox comprising:

a bottom refractory panel including a back edge;

a back refractory panel including a lower edge, said lower edge abutting the bottom refractory panel at said back edge, said back refractory panel including left and right corners, said left and right corners including concave sections; and a pair of side of side refractory panels abutting said back refractory panel at said left and right corners, said pair of side refractory panels including a convex section to define with the back refractory panel a generally rectangular combustion chamber including arcuate convex left and right rear corners.

2. The firebox of claim 1 further comprising: an upper refractory panel including a underside surface.

3. The firebox of claim 2 wherein said upper refractory panel includes one or more transverse ramp portions.

4. The firebox of claim 3 wherein each of said one or more ramp portions includes an angled side and a low-angled side.

5. The firebox of claim 4 wherein each of said one or more ramp portions includes one or more slots oriented perpendicular to a length of said ramp portions.

* * * * *